US006942519B2

(12) United States Patent
Chen

(10) Patent No.: US 6,942,519 B2
(45) Date of Patent: Sep. 13, 2005

(54) ELECTRONIC APPARATUS HAVING FUNCTION OF RECEIVING POWER CORD

(75) Inventor: Chun-Chen Chen, Taoyuan (TW)

(73) Assignee: Delta Electronics, Inc., Taipei (TW)

( * ) Notice: Subject to any disclaimer, the term of this patent is extended or adjusted under 35 U.S.C. 154(b) by 0 days.

(21) Appl. No.: 10/442,117

(22) Filed: May 21, 2003

(65) Prior Publication Data

US 2004/0097126 A1 May 20, 2004

(30) Foreign Application Priority Data

Nov. 19, 2002 (TW) ..... 91218591 U

(51) Int. Cl.[7] ..... H01R 13/72
(52) U.S. Cl. ..... 439/501; 439/135
(58) Field of Search ..... 439/501, 135, 439/136, 142, 133–134, 719, 4; 174/135

(56) References Cited

U.S. PATENT DOCUMENTS 4,865,557 A * 9/1989 Kershaw ..... 439/133
5,738,536 A * 4/1998 Ohgami et al. ..... 439/142
6,135,810 A * 10/2000 Damson et al. ..... 439/501
6,155,870 A * 12/2000 Valentine ..... 439/501
6,369,321 B1 * 4/2002 Flegel ..... 174/135
6,406,327 B1 * 6/2002 Soon ..... 439/501

* cited by examiner

*Primary Examiner*—Tho D. Ta
*Assistant Examiner*—Felix O. Figueroa
(74) *Attorney, Agent, or Firm*—Bacon & Thomas

(57) ABSTRACT

An electronic apparatus having a function of receiving a power cord. The electronic apparatus includes a housing including a surface having a hole and a portion, a power cord having a first end passing through the hole for electrically connecting to an interior of the electronic apparatus, and a cover connected with the surface for covering the portion, thereby allowing a remaining portion of the power cord to be wound around the portion and received the power cord in the cover.

7 Claims, 9 Drawing Sheets

ELECTRONIC APPARATUS HAVING FUNCTION OF RECEIVING POWER CORD

FIELD OF THE INVENTION

The present invention relates to an electronic apparatus having a function of receiving a power cord, and more particularly to an adapter, a power supply or a charger having a function of receiving a power cord.

BACKGROUND OF THE INVENTION

Adapter, power supply or charger is a popular electronic apparatus used in our daily life. The adapter, power supply or charger is generally employed to rectify and convert commercially available AC power into DC power, so as to supply the required power to operate or charge the power-receiving devices, such as printer, notebook or cellular phone.

Please refer to FIG. 1 which is a diagram illustrating a structure of a conventional adapter. As shown in FIG. 1, the conventional adapter includes a housing 11 and a power cord 13. The housing 11 has a surface 12 having a hole for passing the power cord 13 therethrough. The power cord 13 is electrically connected to an internal printed circuit board (not shown in FIG. 1) of the adapter and used as an outlet of the adapter for providing the required DC power to the power-receiving devices.

Since the power cord 13 has a length of from about 1 to 10 meters, a special consideration should be given to secure the power cord 13. A strap 14 is widely used to secure a bundled power cord 13 for storage. When the adapter is employed, the strap 14 has to be unfastened in advance and the power cord 13 can be stretched out to connect with a power-receiving device.

However, there still exist some disadvantages in practice by using the above-mentioned strap 14 to receive and secure the power cord 13 of the adapter.

1. The bundling strap 14 is readily lost, because the strap 14 is separable from the housing 11 of the adapter.

2. After the power cord 13 is bound by the strap 14, the bundled power cord 13 not only occupies a lot of space for storing but also gets entangled with other power cords or wires easily.

3. If the power cord 13 is separable from the adapter, it is easily lost when it is put away in the different place.

Therefore, there is a need to provide an electronic apparatus having a function of receiving a power cord so as to overcome the above situations encountered in the prior art.

SUMMARY OF THE INVENTION

An object of the present invention is to provide an electronic apparatus having a function of receiving a power cord for efficiently receiving the power cord and conveniently putting the electronic apparatus away.

For the purpose of attaining the foregoing objective, the present invention is achieved by providing an electronic apparatus having a function of receiving a power cord. The electronic apparatus includes a housing including a surface having a hole and a portion, a power cord having a first end passing through the hole for electrically connecting to an interior of the electronic apparatus, and a cover connected with the surface for covering the portion, thereby allowing a remaining portion of the power cord to be wound around the portion and received the power cord in the cover.

BRIEF DESCRIPTION OF THE DRAWINGS

The present invention may best be understood through the following description with reference to the accompanying drawings, in which.

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

The present invention provides an electronic apparatus having a power cord receiving function. Although the following embodiments use the adapters to be exemplifications, the electronic apparatus can be a battery charger, a power supply, a transformer or any electronic apparatus having a power cord.

Figure 1:
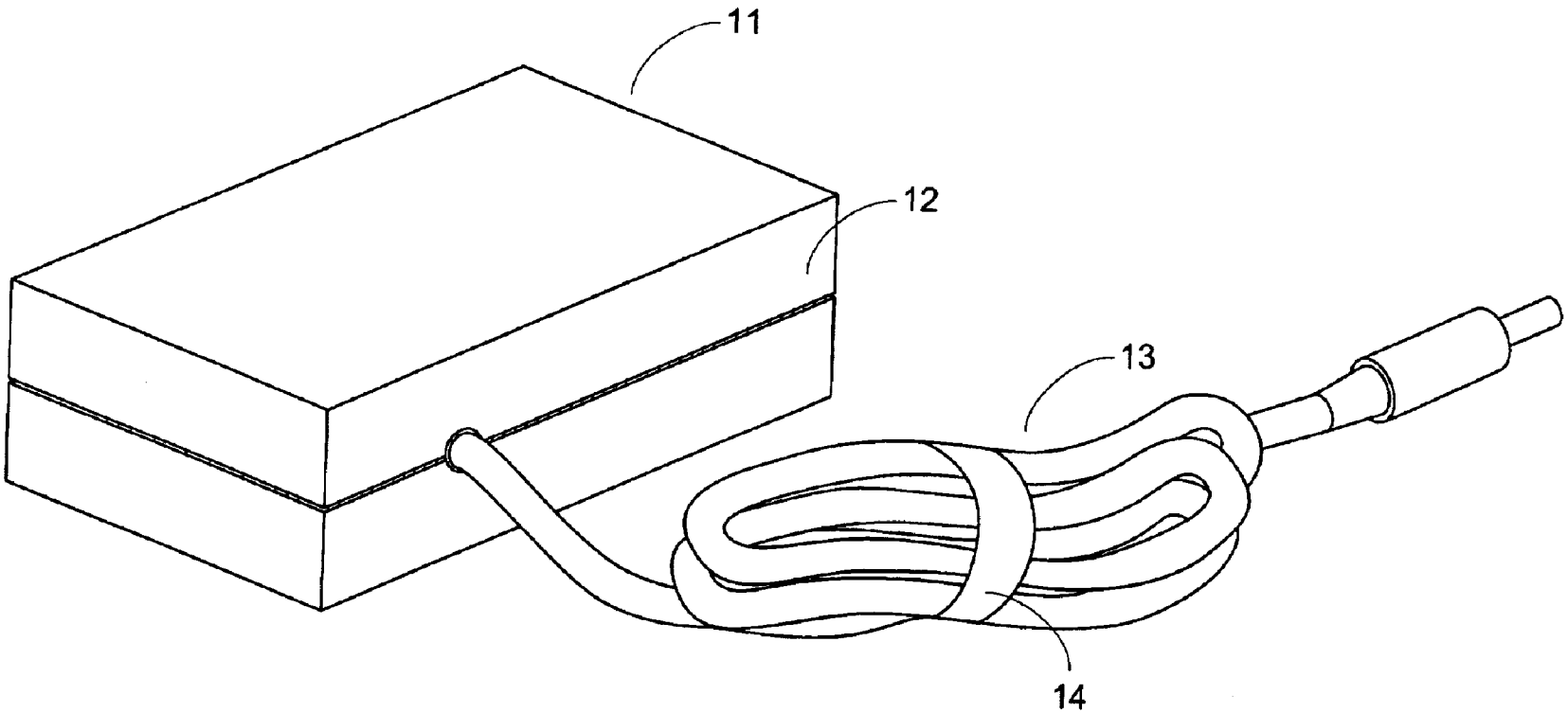
Fig.1 Prior Art
FIG. 1 is a schematic diagram illustrating a structure of a conventional adapter.
Figure 2:
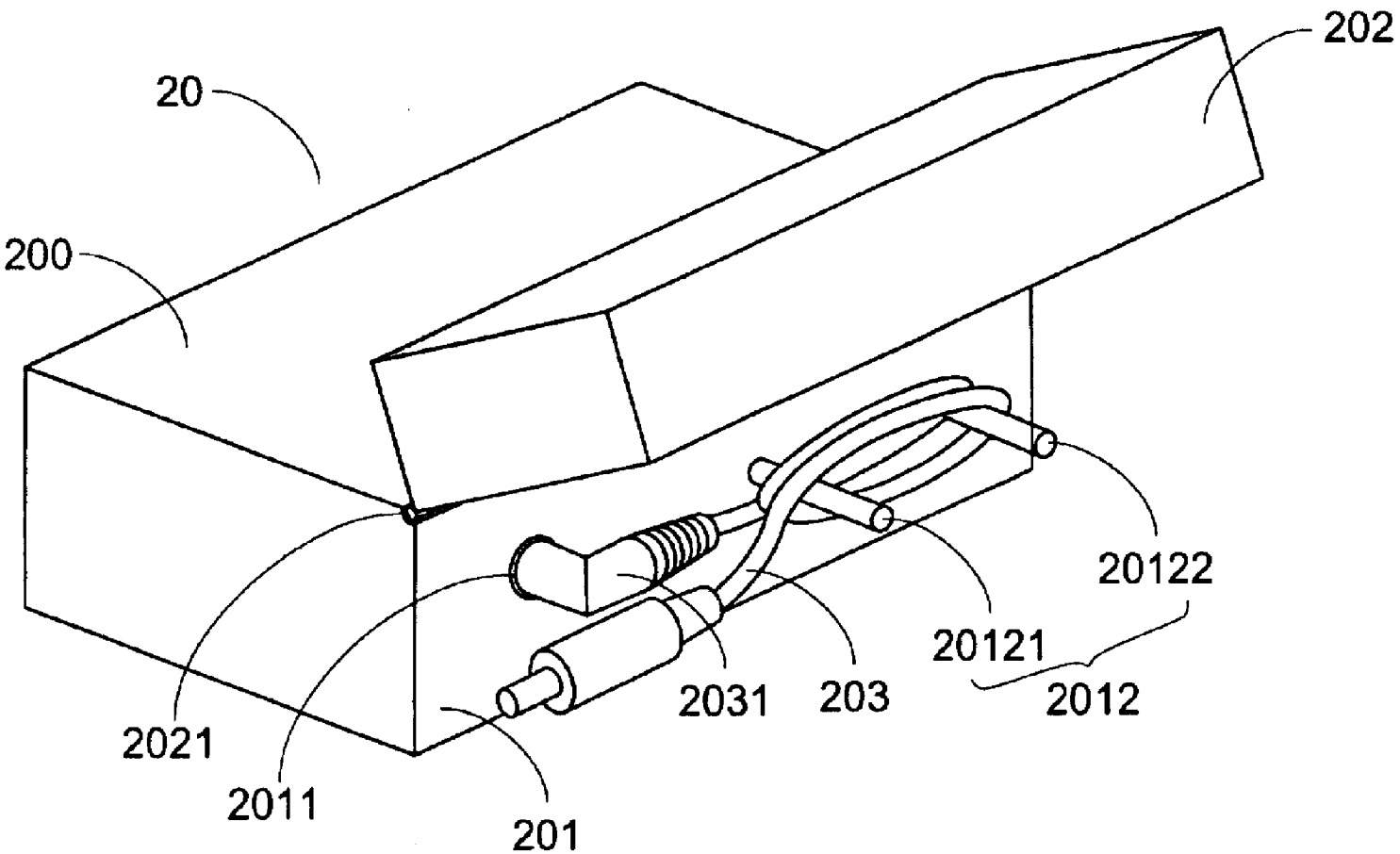
FIG. 2 is a schematic structure diagram illustrating a preferred embodiment of an adapter having a function of receiving a power cord according to the present invention.

Please refer to FIG. 2 which is a schematic structure diagram illustrating a preferred embodiment of an adapter having a function of receiving a power cord according to the present invention. As shown in FIG. 2, the adapter 20 includes a housing 200, a cover 202 and a power cord 203. A surface 201 of the housing 200 has a hole 2011 for passing the power cord 203 therethrough and a portion 2012 for winding the power cord 203 therearound. The cover 202 is rotatably connected to the surface 201 of the housing 200 via a shaft 2021 for achieving a close and open function. When the cover 202 is closed, the portion 2012 is completely covered by the cover 202. One end 2031 of the power cord 203 forming an angle passes through the hole 2011 to electrically connect to the internal printed circuit board (not shown in FIG. 2). The end 2031 of the power cord 203 can be connected to the internal printed circuit board (not shown in FIG. 2) in a direct or separable manner. The portion 2012 includes two protrusions 20121 and 20122 for winding al least one portion of the power cord 203 therearound. When the adapter 20 is not used, the power cord 203 can be wound around two protrusions 20121 and 20122. Once the cover 202 is closed, the cover 202 provides a space for accommodating the two protrusions 20121 and 20122 with the power cord 203 therein.

Figure 3B:
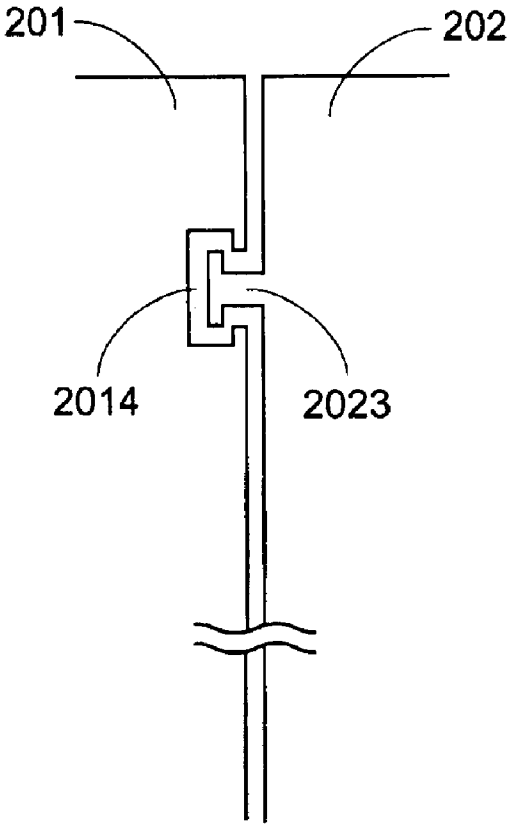
FIG. 3B is a schematic cross-sectional view illustrating another preferred embodiment of a connection manner between a cover and a housing of the adapter in FIG. 2.
Figure 3A:
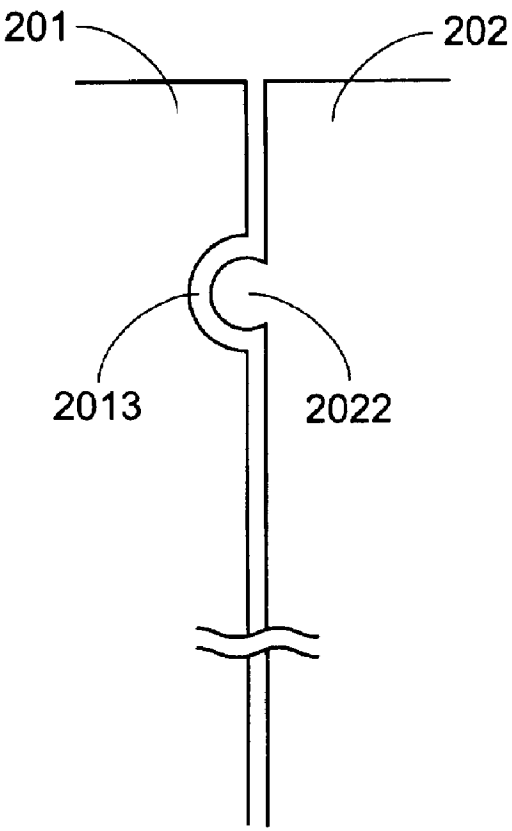
FIG. 3A is a schematic cross-sectional view illustrating a preferred embodiment of a connection manner between a cover and a housing of the adapter in FIG. 2.

Besides the shaft connection manner as shown in FIG. 2, the adapter can employ engaging and track-slipping manner to connect the housing with the cover as shown in FIGS. 3A and 3B, respectively. FIGS. 3A and 3B are schematic cross-sectional views illustrating these two connection manners between the cover and the housing of the adapter, respectively. As shown in FIG. 3A, at least one protrusion 2022 of the cover 202 is engaged with a groove 2013 of the surface 201 of the housing for connecting the cover 202 to the housing. In another embodiment, the cover 202 includes at least one track 2023 corresponding to a slot 2014 of the surface 201 of the housing as shown in FIG. 3B. When the track 2023 slips into the slot 2014, the cover 202 is connected with the housing.

Figure 4:
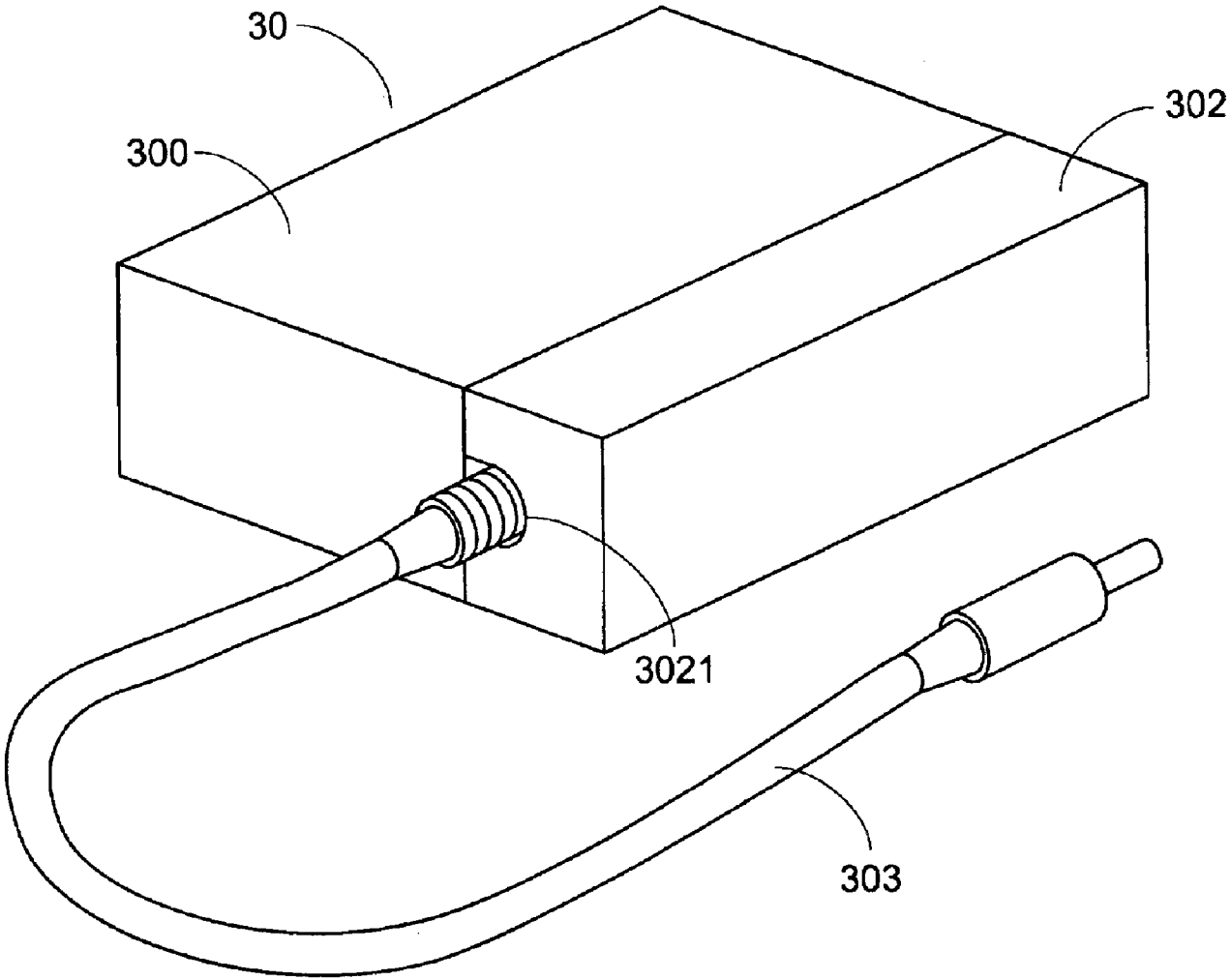
FIG. 4 is a schematic structure diagram illustrating another preferred embodiment of an adapter having a function of receiving a power cord according to the present invention.

Please refer to FIG. 4 which is a schematic structure diagram illustrating another preferred embodiment of an adapter having a function of receiving a power cord according to the present invention. The structure and function of the elements of the adapter 30 in FIG. 4 are similar to those of the adapter 20 in FIG. 2 except that the cover 302 of the adapter 30 includes an indentation 3021 for passing the power cord 303 therethrough when the adapter 30 is used. Besides guiding the outlet direction of the power cord 303, the indentation 3021 can be designed to further fix the power cord 303 for preventing the power cord 303 from coming off the housing 300 during the working condition.

Figure 5:
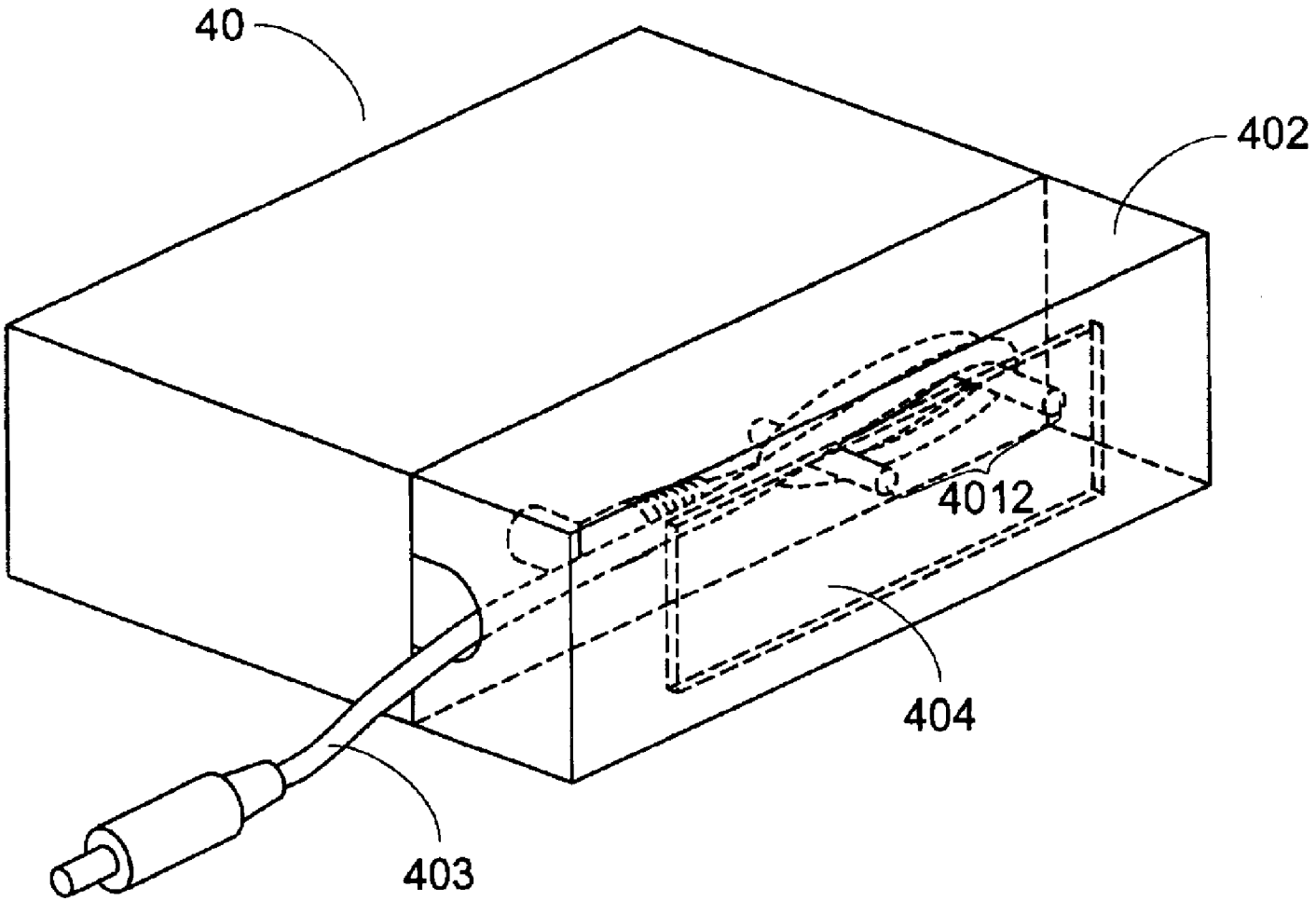
FIG. 5 is a schematic structure diagram illustrating a further preferred embodiment of an adapter having a function of receiving a power cord according to the present invention.

Please refer to FIG. 5 which is a schematic structure diagram illustrating a further preferred embodiment of an adapter having a function of receiving a power cord according to the present invention. The structure and function of the elements of the adapter 40 in FIG. 5 are similar to those of the adapter 20 in FIG. 2 except that there is at least one metal plate 404 disposed on the internal surface of the cover 402 for preventing from the electromagnetic interference (EMI) generated by the power cord 403. In addition, when the power cord 403 needn't to be use in full-length, the unnecessary portion of the power cord 403 can be wound around the protrusion 4012 as shown in FIG. 5.

Figure 6A:
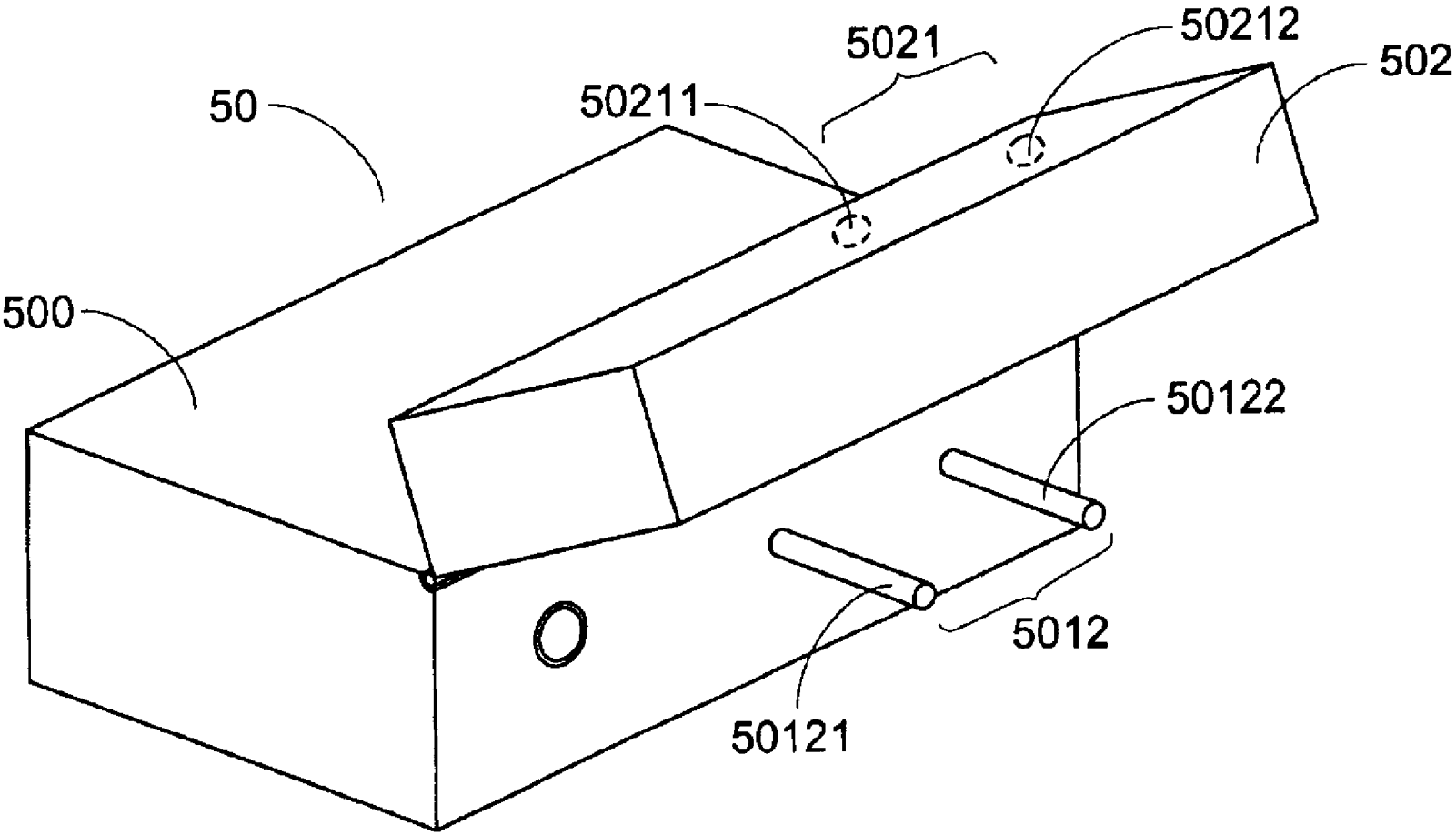
FIGS. 6A–B are schematic diagrams illustrating a preferred embodiment of an engaging structure between a cover and a housing of an adapter according to the present invention.
Figure 6B:
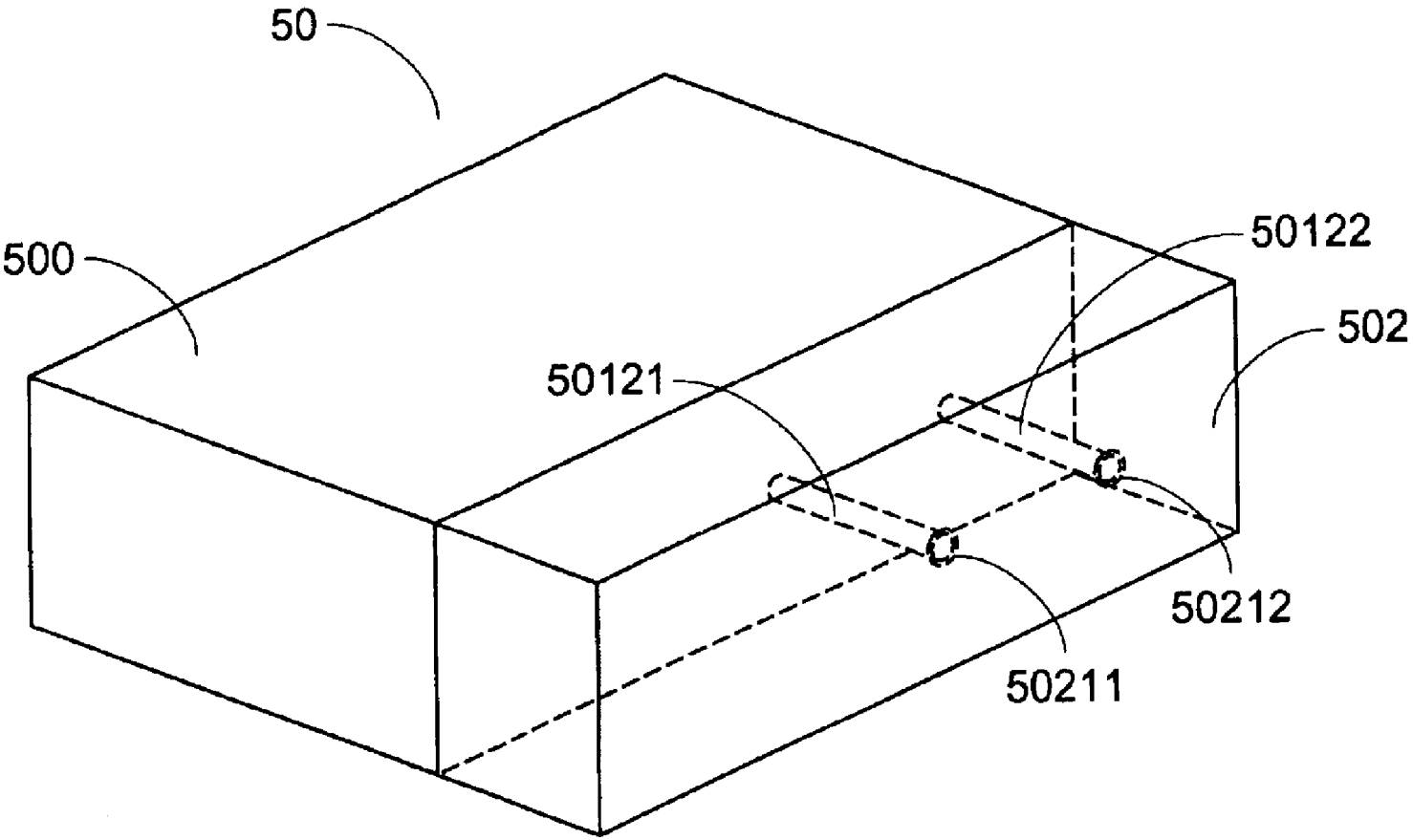

Please refer to FIGS. 6A–6B, which are schematic diagrams illustrating a preferred embodiment of an engaging structure between a cover and a housing of an adapter according to the present invention. The structure and function of the elements of the adapter 50 in FIGS. 6A and 6B are similar to those of the adapter 20 in FIG. 2 except that there is an engaging part 5021 disposed on the internal surface of the cover 502 and corresponding to the portion 5012 of the housing 500. The engaging part 5021 includes two indentations 50211 and 50122 corresponding to the two protrusions 50121 and 50122, respectively, as shown in FIG. 6A. When the cover 502 is closed, the two protrusions 50121 and 50122 are engaged with the two indentations 50211 and 50212, respectively, for further fixing the cover 502 to the housing 500 and preventing the power cord (not shown in FIG. 6A) from coming off.

Figure 7:
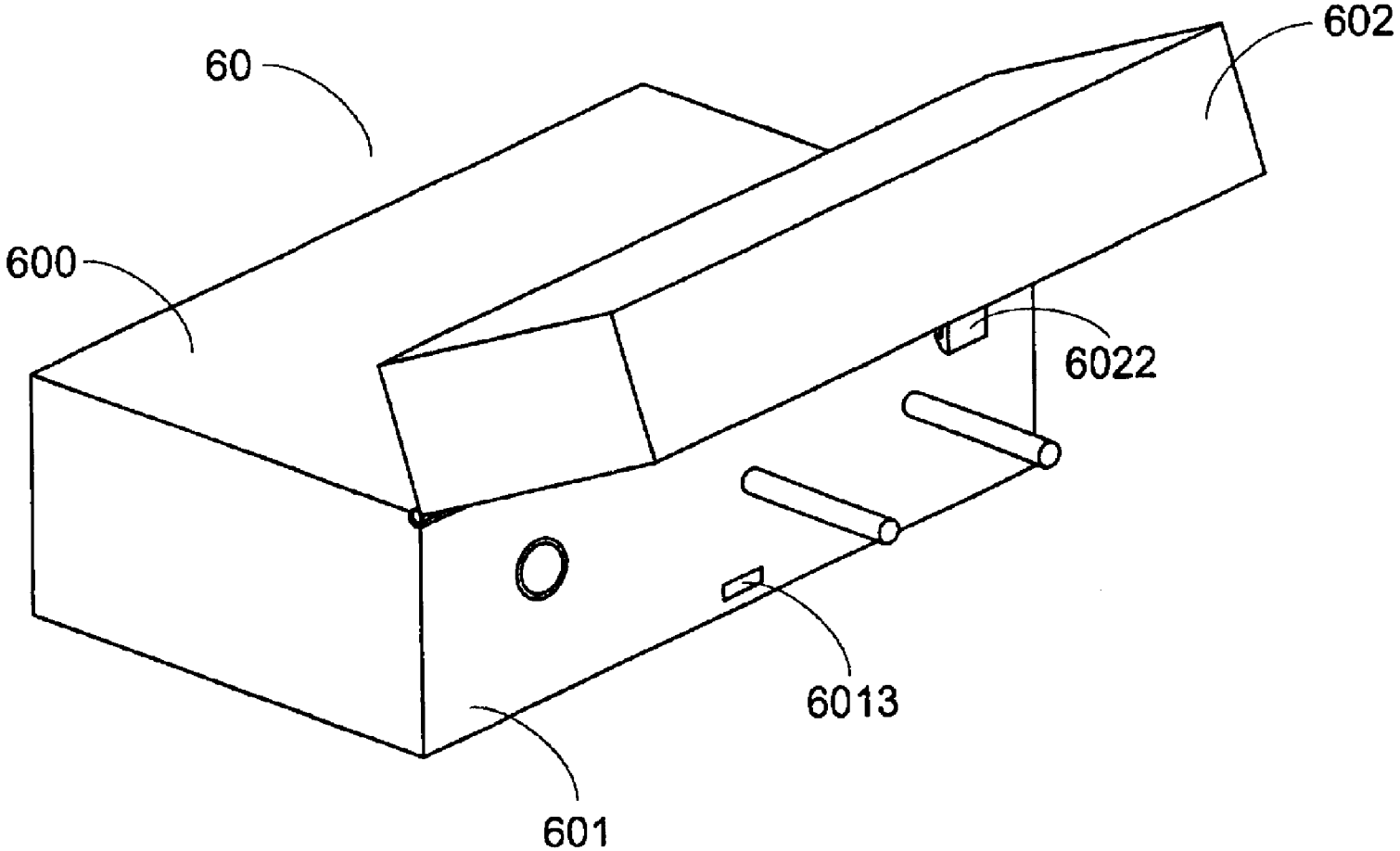
FIG. 7 is a schematic diagram illustrating another preferred embodiment of an engaging structure between a cover and a housing of an adapter according to the present invention.

Please refer to FIG. 7 which is a schematic diagram illustrating another preferred embodiment of an engaging structure between a cover and a housing of an adapter according to the present invention. The structure and function of the elements of the adapter 60 in FIG. 7 are similar to those of the adapter 20 in FIG. 2 except that there is an engaging structure in the adapter 60. As shown in FIG. 7, the cover 602 includes a hook 6022 corresponding to a groove 6013 on the surface 601 of the housing 600. Hence, when the cover 602 is closed, the hook 6022 is engaged with the groove 6013 for fixing the cover 602 to the housing 600.

Figure 8:
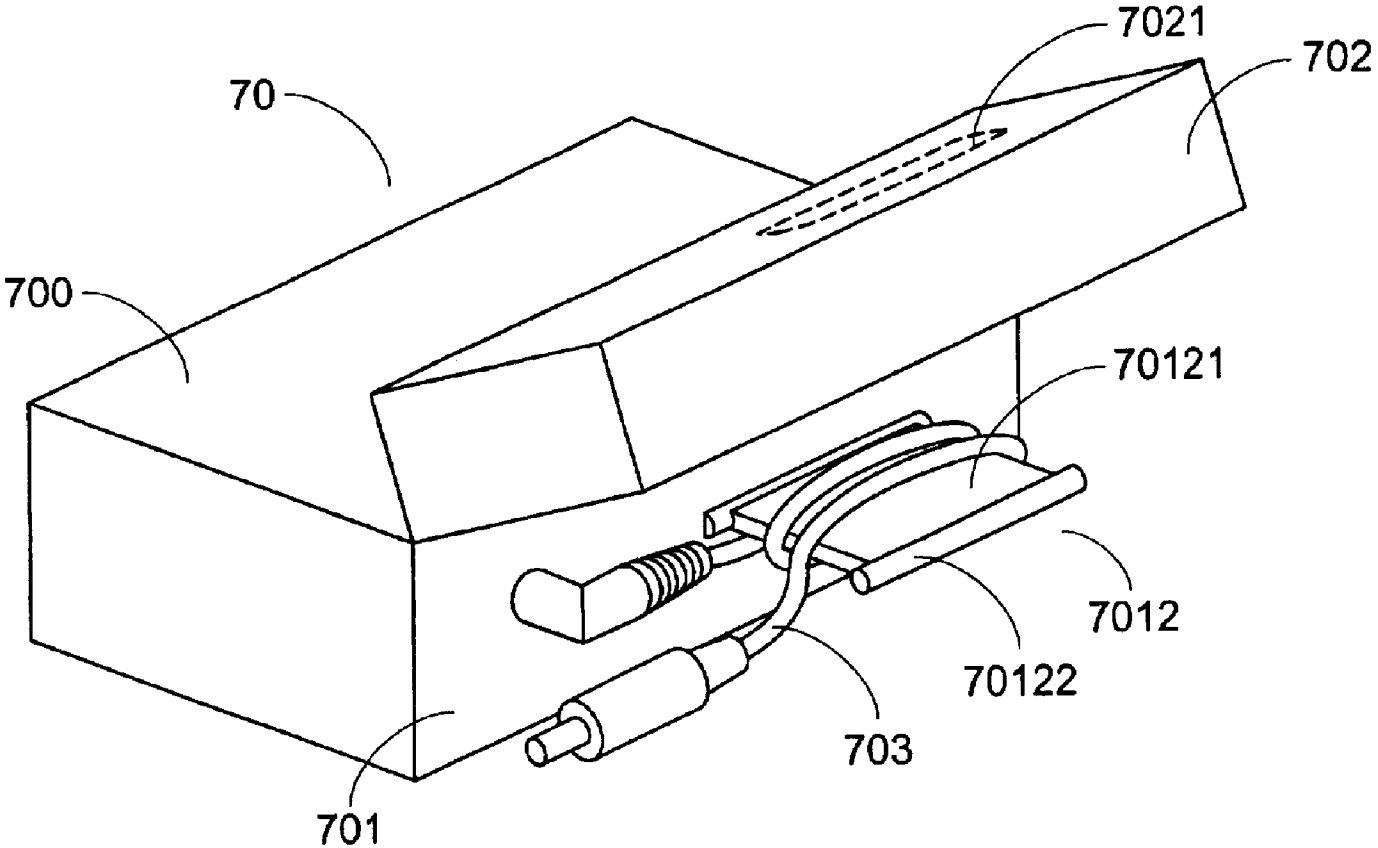
FIG. 8 is a schematic structure diagram illustrating a further preferred embodiment of an adapter having a function of receiving a power cord according to the present invention.

Please refer to FIG. 8 which is a schematic structure diagram illustrating a further preferred embodiment of an adapter having a function of receiving a power cord according to the present invention. The structure and function of the elements of the adapter 70 in FIG. 8 are similar to those of the adapter 20 in FIG. 2 except the structure for winding the power cord therearound. As shown in FIG. 8, the adapter 70 includes a portion 7012 disposed on the surface 701 of the housing 700 for winding the power cord 703 therearound. The portion 7012 includes an extended plate 70121 and an edge bar 70122. The length of the edge bar 70122 is larger than the width of the extended plate 70121. Two ends of the extended plate 70121 are connected to the surface 701 and the edge bar 70122, respectively, as shown in FIG. 8. When the adapter 70 is not used and needs to be put away, the power cord 703 can be winding around the extended plate 70121 and the edge bar 70122 is used for preventing the power cord 703 from coming off the extended plate 70121. In addition, the cover 702 includes a slot 7021 disposed on the internal surface thereof and corresponding to the edge bar 70122. When the cover 702 is closed, the edge bar 70122 is engaged with the slot 7021 for fixing the cover 702 to the housing 700.

Certainly, the shapes of the cover and the portion for winding the power cord therearound are not limited to the form disclosed.

As will be apparent from the above description, the present invention provides an electronic apparatus including a portion for winding the power cord therearound and a cover for receiving the power cord and the portion therein. Therefore, the power cord of the electronic apparatus is not easily lost when it is separated from the adapter. In addition, since the power cord is received within the cover of the electronic apparatus, the power cord will be no longer suspended over the housing and the problem of losing bundling strap 14 will not exist.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An electronic apparatus for receiving a power cord, comprising:

a power cord;

a housing including an outer surface having a hole and a portion for winding said power cord therearound, said portion including two protrusions for winding said power cord therearound; and a cover connected with said outer surface of said housing for covering said portion therein, said cover including two indentations corresponding to said two protrusions, respectively, for engaging with said two protrusions when said cover is closed;

thereby allowing a first end of said power cord to pass through said hole for electrically connecting to an interior of said electronic apparatus, winding a remaining portion of said power cord around said portion and receiving said power cord in said cover.

2. The electronic apparatus according to claim 1 wherein said electronic apparatus is one selected from the group consisting of an adapter, a power supply and a charger.

3. The electronic apparatus according to claim 1 wherein said cover further comprises an indentation for passing said power cord therethrough and limiting the outlet direction of said power cord.

4. The electronic apparatus according to claim 1 wherein said cover is rotatably connected with said outer surface of said housing by a shaft.

5. The electronic apparatus according to claim 1 wherein said cover is engaged with said outer surface of said housing.

6. The electronic apparatus according to claim 1 wherein said first end of said power cord forms an angle.

7. An electronic apparatus for receiving a power cord, comprising:

a housing including an outer surface having a hole and a portion, said portion including two protrusions for winding said power cord therearound;

a power cord having a first end passing through said hole for electrically connecting to an interior of said electronic apparatus; and a cover connected with said outer surface for covering said portion, said cover including two indentations corresponding to said two protrusions, respectively, for engaging with said two protrusions when said cover is closed;

thereby allowing a remaining portion of said power cord to be wound around said portion and receive said power cord in said cover.

* * * * *